United States Patent [19]

Yamamoto

[11] 4,123,071

[45] Oct. 31, 1978

[54] WATER-DRAINABLE GASKET

[75] Inventor: Yukio Yamamoto, Uozu, Japan

[73] Assignee: Yoshida Kogyo K.K., Tokyo, Japan

[21] Appl. No.: 835,181

[22] Filed: Sep. 21, 1977

[30] Foreign Application Priority Data

Sep. 22, 1976 [JP] Japan ..... 51-128309[U]
Oct. 8, 1976 [JP] Japan ..... 51-136147[U]

[51] Int. Cl.[2] ..... E06B 7/23; E06B 7/26

[52] U.S. Cl. ..... 277/205; 277/207 R; 49/476; 49/490

[58] Field of Search ..... 277/205, 207 R, 237 R; 49/475, 476, 488–491, 493; 296/93

[56] References Cited

U.S. PATENT DOCUMENTS

| | | | |
|---|---|---|---|
| 2,018,115 | 10/1935 | Barringer | 49/476 |
| 2,772,915 | 12/1956 | Renno | 296/93 X |
| 3,894,371 | 7/1975 | Yamaha | 49/476 X |

FOREIGN PATENT DOCUMENTS

| | | | |
|---|---|---|---|
| 538,531 | 6/1955 | Belgium | 49/490 |
| 1,534,829 | 9/1969 | Fed. Rep. of Germany | 49/476 |
| 1,414,478 | 9/1965 | France | 277/205 |
| 355,929 | 9/1961 | Switzerland | 49/476 |

*Primary Examiner*—Robert S. Ward, Jr.
*Attorney, Agent, or Firm*—Hill, Gross, Simpson, Van Santen, Steadman, Chiara & Simpson

[57] ABSTRACT

A water-drainable gasket for use between a panel and a frame includes a continuous channel-shaped body having a pair of spaced sidewalls and a bottom wall. A plurality of pairs of transversely spaced water draining holes extend through the bottom, each pair of the holes being transversely aligned with each other. The pairs of the holes are spaced at an interval along the length of the continuous gasket. The holes in each pair are located adjacent to or extend partly through the sidewalls. Further, the holes extend perpendicularly to the bottom or at an angle to each other and to the sidewalls.

8 Claims, 10 Drawing Figures

WATER-DRAINABLE GASKET

BACKGROUND OF THE INVENTION

1. Field of the Invention

The present invention relates to a water-drainable gasket for use between a panel such as a glass pane and a frame extending peripherally therearound.

2. Summary of the Invention

According to the present invention, a continuous channel-shaped gasket of resiliently flexible material has a plurality of pairs of apertures extending through a bottom of the gasket, the apertures in each pair being transversely spaced from and aligned with each other. The pairs of apertures are disposed at an interval spaced along the length of the continuous gasket.

An object of the present invention is to provide a window or door gasket that can drain any water that may have entered therein.

Another object of the present invention is to provide a water-drainable continuous gasket having draining apertures spaced therealong at which the gasket can easily be cut and bent for installation around the corners of a window or door panel.

Many other advantages and features of the present invention will become manifest to those versed in the art upon making reference to the detailed description and the accompanying sheets of drawings in which preferred structural embodiments incorporating the principles of the present invention are shown by way of illustrative example.

DESCRIPTION OF THE PREFERRED EMBODIMENTS

Figure 1:
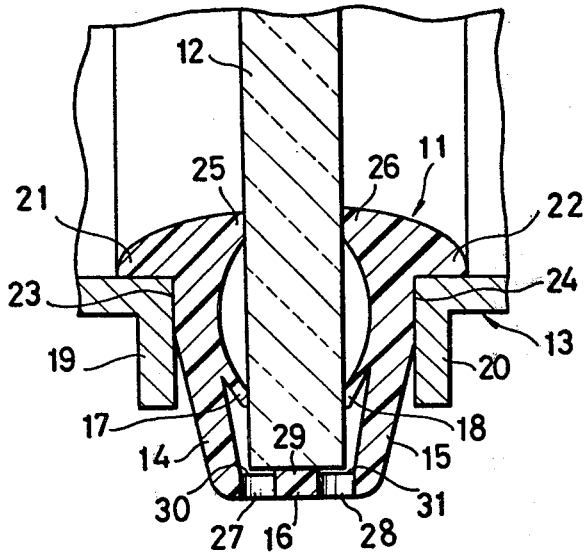
FIG. 1 is a cross-sectional view of a water-drainable gasket constructed in accordance with the present invention.

As shown in FIG. 1, a water-drainable gasket 11 comprises a continuous resiliently flexible body made of rubber or plastic and having a substantially U-shaped cross-section. The gasket 11 is disposed between a panel 12 such as a pane of glass and a frame 13 extending peripherally around the panel 12. The channel-shaped gasket 11 extends around and receives the peripheral edges of the panel 12. The gasket 11 includes a pair of spaced sidewalls 14,15 and a bottom wall 16 extending between and interconnecting the sidewalls 14,15.

A pair of barb-like retaining ribs 17,18 are oppositely disposed on the inner surfaces of the sidewalls 14,15 respectively. The ribs 17,18 have lengths which are disposed in parallel relationship with each other and the ribs are longitudinally coextensive with the sidewalls 14,15 which carry them. Each rib extends obliquely inwardly at an angle toward the bottom wall 16. When the peripheral edges of the panel 12 are inserted into the channel of the gasket 11, the ribs 17,18 engage the faces of the panel 12. Any tendency for the panel 12 to move out of the gasket 11 will cause the opposed ribs 17,18 to swing toward each other, thereby increasing the gripping action on the panel 12.

The gasket 11 is supported on and disposed between a pair of oppositely spaced L-shaped lips 19,20 of the frame 13. The sidewalls 14,15 have a pair of flanges 21,22, respectively, provided at the edges remote from the bottom wall 16. The flanges 21,22 and the sidewalls 14,15 jointly provide recessed surfaces 23,24, respectively, that are disposed in contact with and extend around the corners of the L-shaped lips 19,20, respectively. Thus the gasket 11 is retained in place on the frame 13.

The sidewalls 14,15 have a pair of retaining arms 25,26, respectively, directed away from the flanges 21,22 toward one another. The arms 25,26 grip and support the panel 12 therebetween against sidewise displacement thereof.

Figure 2:
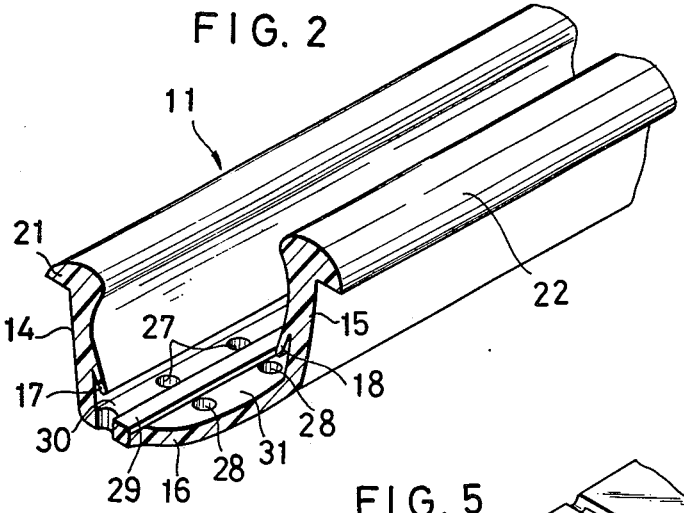
FIG. 2 is a fragmentary perspective view of the gasket shown in FIG. 1.

A plurality of pairs of transversely spaced passage means 27,28 such as circular holes are provided in the bottom wall 16. As better shown in FIG. 2, the holes 27,28 in each pair are transversely aligned with each other. The pairs of the holes 27,28 are spaced at an interval along the length of the continuous gasket 11. Each of the holes 27,28 is located closely to the sidewalls 14,15, respectively, and extends perpendicularly to the bottom wall 16.

Between the spaced holes 27,28, there is a ridge 29 on the bottom wall 16 extending along the continuous gasket 11. The ridge 29 has a raised top surface on which is supported a peripheral edge of the panel 12. Thus a pair of water collection channels 30,31 are provided, one on each side of the ridge 29.

Any water entering the gasket 11 down along the panel 12 past the arms 25,26 and the ribs 17,18 is collected in the channels 30,31 and drained through the holes 27,28.

Figure 3:
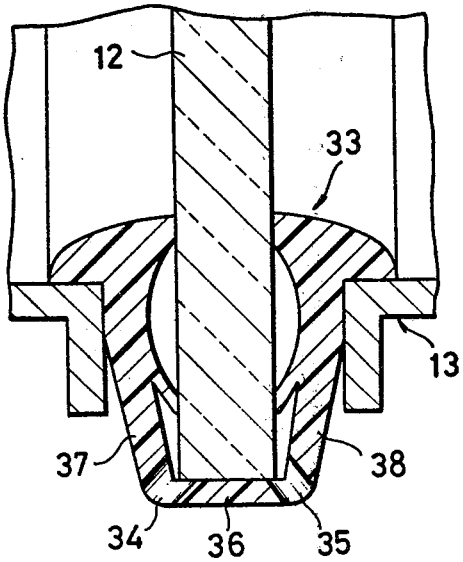
FIG. 3 (on sheet 1) is a cross-sectional view of a second embodiment of a water-drainable gasket.

In a gasket 33 of a second embodiment shown in FIG. 3, a plurality of pairs of water draining circular holes 34,35 pass through both a bottom wall 36 and a pair of sidewalls 37,38. Each of the holes 34,35 is located at a point where the bottom wall 36 and the sidewalls 37,38 are interconnected, and they extend at an angle to each other and to the sidewalls 37,38.

Figure 4:
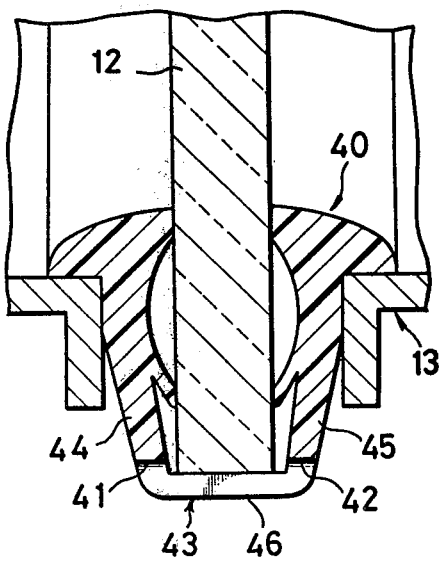
FIG. 4 is a cross-sectional view of a third embodiment of a water-drainable gasket.
Figure 5:
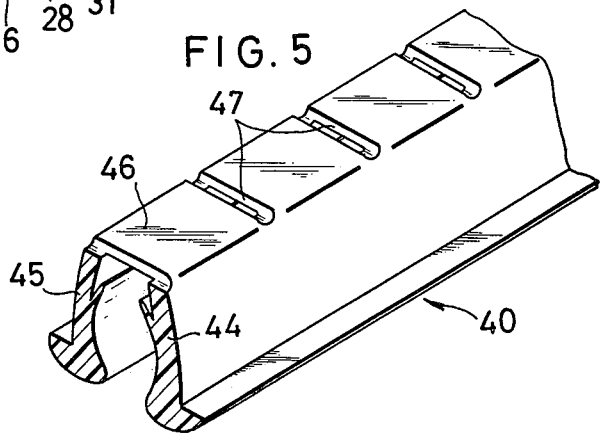
FIG. 5 is a fragmentary perspective view of the gasket shown in FIG. 4.

In a third embodiment illustrated in FIG. 4, a gasket 40 has a plurality of pairs of water draining holes 41,42 having portions extending through a bottom wall 43 and through a pair of sidewalls 44,45. Between each pair of the holes 41,42, there is a transverse slot 47 communicating with the holes 41,42. As best shown in FIG. 5, the pairs of the holes 41,42 and the interconnecting slots 47 jointly provide a plurality of transverse grooves located at a spaced interval along the length of the gasket 40.

In the second and third embodiments, a panel edge is directly placed on the bottom wall 36 (46), and covers portions of the holes 34,35 or the slots 47 that extend through the bottom wall 36,46. However, the portions of the holes 34,35 (41,42) extending through the sidewalls 37,38 (44,45) can discharge any collected water out of the gasket 33 (40).

Figure 6:
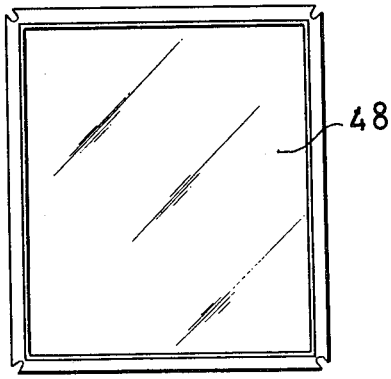
FIG. 6 is a front elevational view, on a reduced scale, of a window panel the gasket according to one of the first, second and third embodiments extending around the peripheral edges thereof.

At the time any one of the gaskets 11,33, and 40 is installed around the edges of a window panel 48 (FIG. 6), the gasket is cut or notched at points where it is bent around the corners of the panel 48. With the drainage holes so spaced along the gasket that some of them will be positioned on the corners of the panel 48, the gasket can be easily cut at such holes.

Further, the gaskets 11,33, and 40 having the water draining holes are flexible enough to be easily mounted around the panel and to support the panel resiliently, thus lessening the danger of the panel's being broken when subjected to deforming forces.

Figure 7:
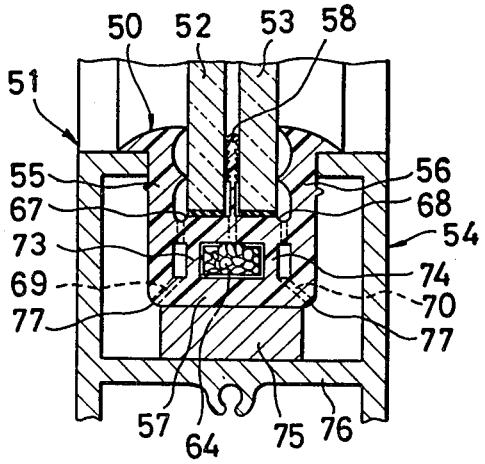
FIG. 7 is a cross-sectional view of a fourth embodiment of a water-drainable gasket.
Figure 8:
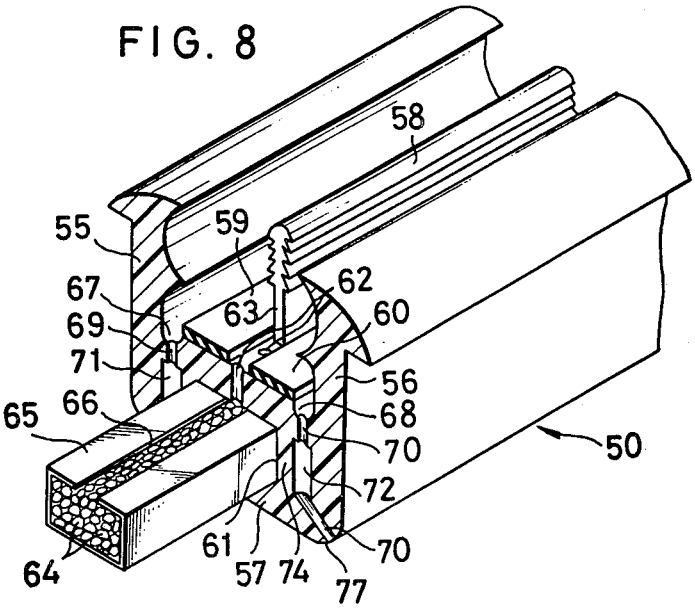
FIG. 8 is a fragmentary perspective view of the gasket of FIG. 7.

FIGS. 7 and 8 illustrate a fourth embodiment in which a continuous gasket 50 is used in a double-glazed window 51 having a pair of spaced panels 52,53 and a frame 54 disposed in peripherally surrounding relation to the panels 52,53. The gasket 50 has a substantially U-shaped cross-section comprising a pair of sidewalls 55,56 and a bottom 57 extending between and interconnecting the sidewalls 55,56.

A central spacer 58 extends from the bottom 57 and is situated between the sidewalls 55,56, the spacer 58 extending intermittently along the continuous gasket 50. The spacer 58 is interposed between the panels 52,53 to space them a slight distance from each other. The panels 52,53 have peripheral edges placed on the bottom 57 with a pair of elongate rubber seals 59,60 (FIG. 8) therebetween, the rubber seals 59,60 being located one on each side of the spacer 58.

An opening 61 (FIG. 8) is provided in the bottom 57 and extends along the length thereof. The opening 61 communicates with the space between the panels 52,53 through a series of apertures 62 provided at gaps 63 in the spacer 58. Within the opening 61, there is disposed desiccant material 64 housed in a container 65 made of a plastic film, the container 65 having a central slot 66 held in registration with the apertures 62. The desiccant material 64 absorbs any trapped moisture within the space which is provided by the panels 52,53 and the bottom 57 of the enclosing gasket 50, so that moisture condensation on the panel surfaces which face each other will be prevented.

The bottom 57 has a pair of water collecting channels 67,68 adjacent to the sidewalls 55,56, respectively, the channels 67,68 extending along the bottom 57 and being provided one on each side of the rubber seals 59,60. A plurality of pairs of water draining holes 69,70 extend across and through the bottom 57 at the channels 67,68, the holes 69,70 in each pair being transversely spaced from and aligned with one another. The pairs of the holes 69,70 are located at an interval spaced along the length of the continuous gasket 50.

A pair of elongate reservoirs 71,72 are provided in the bottom 57 and extend along the length of the gasket 50. The reservoirs 71,72 extend across and communicate with the pairs of holes 69,70, respectively, and are spaced from the opening 61 by a pair of partitions 73,74 therebetween.

The gasket 50 is carried on a support 75 placed on a partition 76 of the frame 54. The support 75 has a width which is substantially the same as that of the bottom 57. The lower end portion of each of the holes 69,70 is directed diagonally and diverges away from the other hole 70,69 such that its discharge port opens at a corner 77 of the bottom 57 that is disposed beyond the support 75.

When the gasket 50 is to be mounted around the edges of the panels 52,53, a length of the gasket 50 that corresponds to the length of one edge of the panels 52,53 is first prepared and mitered at its ends. The opening 61 is then filled with the desiccant material 64 housed in the container 65 and its ends are closed off with suitable material. The piece of the gasket 50 thus provided is attached to the edge of the panels 52,53. The remaining panel edges are furnished with the corresponding lengths of the gasket 50 that are similarly finished.

Figure 9:
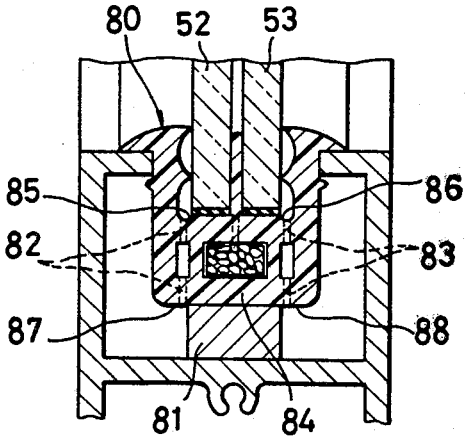
FIG. 9 is a cross-sectional view of a fifth embodiment of a water-drainable gasket.

A modification of the structure of FIG. 7 is shown in FIG. 9 and is referred to as a fifth embodiment. A gasket 80 is supported on a support 81 having a width substantially the same as the combined width of the spaced panels 52,53. The gasket 80 has a plurality of pairs of water draining holes 82,83 in its bottom 84, the holes 82,83 extending straight from a pair of water-collecting channels 85,86, respectively, to a pair of bottom surfaces 87,88 of the bottom 84 that overhang the support 81.

Figure 10:
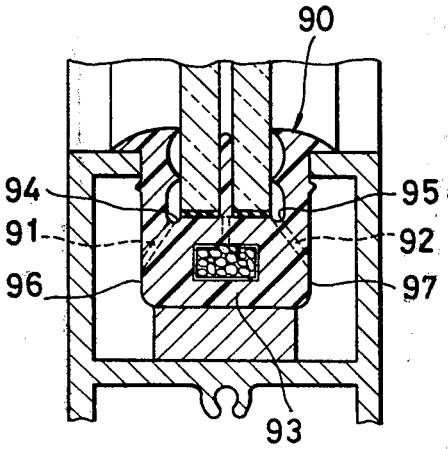
FIG. 10 is a cross-sectional view of a sixth embodiment of a water-drainable gasket.

According to a further modification or sixth embodiment shown in FIG. 10, a gasket 90 includes plural pairs of water draining holes 91,92 provided in a bottom 93, the holes 91,92 extending from a pair of water collection channels 94,95, respectively. The holes 91,92 in each pair diverge from each other as they extend away from the channels 94,95, with their discharge ports opening at a pair of side surfaces 96,97 of the bottom 93.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A water-drainable gasket for use between a panel and a frame disposed peripherally around the panel, comprising: a continuous resiliently flexible body of a substantially U-shaped cross-section for extending around and receiving the peripheral edges of the panel, said body including a pair of spaced sidewalls and a bottom extending between and interconnecting said sidewalls; and a plurality of pairs of transversely spaced passage means extending through said bottom, said passage means in each pair being transversely aligned with each other, and said pairs of passage means being located at a spaced interval along the length of said continuous body.

2. A water-drainable gasket according to claim 1, each of said passage means extending at least in part perpendicularly to said bottom.

3. A water-drainable gasket according to claim 1, each pair of said passage means extending at least in part through said sidewalls.

4. A water-drainable gasket according to claim 3, said each pair of said passage means extending at an angle to each other and to said sidewalls.

5. A water-drainable gasket according to claim 3, there being a slot extending transversely between and communicating with said each pair of said passage means.

6. A water-drainable gasket according to claim 1, including a ridge on said bottom for supporting thereon an edge of the panel, said ridge being located between each pair of said passage means.

7. A water-drainable gasket according to claim 6, said bottom including a pair of elongate water collection channels each located between said ridge and one of said sidewalls.

8. A water-drainable gasket according to claim 1, said bottom having a pair of elongate reservoirs therein extending along the length of said continuous body, and each of said reservoirs extending across and communicating with one of each pair of said passage means.

* * * * *